US009096806B2

(12) United States Patent
Abba et al.

(10) Patent No.: US 9,096,806 B2
(45) Date of Patent: Aug. 4, 2015

(54) INTEGRATED HYDROPROCESSING AND FLUID CATALYTIC CRACKING FOR PROCESSING OF A CRUDE OIL

(71) Applicants: Ibrahim A. Abba, Dhahran (SA); Raheel Shafi, Dhahran (SA); Abdennour Bourane, Ras Tanura (SA); Essam Sayed, Al-Khobar (SA)

(72) Inventors: Ibrahim A. Abba, Dhahran (SA); Raheel Shafi, Dhahran (SA); Abdennour Bourane, Ras Tanura (SA); Essam Sayed, Al-Khobar (SA)

(73) Assignee: Saudi Arabian Oil Company, Dhahran (SA)

( * ) Notice: Subject to any disclaimer, the term of this patent is extended or adjusted under 35 U.S.C. 154(b) by 315 days.

(21) Appl. No.: 13/847,749

(22) Filed: Mar. 20, 2013

(65) Prior Publication Data

US 2013/0248421 A1 Sep. 26, 2013

Related U.S. Application Data

(60) Provisional application No. 61/613,228, filed on Mar. 20, 2012, provisional application No. 61/789,871, filed on Mar. 15, 2013.

(51) Int. Cl.

| | |
|---|---|
| ***C10G 69/04*** | (2006.01) |
| ***C10G 51/06*** | (2006.01) |
| ***C10G 11/18*** | (2006.01) |
| ***C10G 45/02*** | (2006.01) |
| *C10G 69/14* | (2006.01) |

(52) U.S. Cl.

CPC ..... *C10G 69/04* (2013.01); *C10G 11/18* (2013.01); *C10G 45/02* (2013.01); *C10G 51/06* (2013.01); *C10G 2300/70* (2013.01); *C10G 2400/20* (2013.01)

(58) Field of Classification Search

CPC ..... C10G 69/04; C10G 69/14

See application file for complete search history.

(56) References Cited

U.S. PATENT DOCUMENTS

| | | | | |
|---|---|---|---|---|
| 7,220,351 | B1 * | 5/2007 | Pontier et al. | 208/113 |
| 2004/0124124 | A1 * | 7/2004 | Pinho et al. | 208/113 |
| 2005/0121361 | A1 * | 6/2005 | Duplan et al. | 208/113 |
| 2008/0011645 | A1 * | 1/2008 | Dean | 208/113 |
| 2010/0025291 | A1 * | 2/2010 | Shafi et al. | 208/89 |
| 2012/0241358 | A1 * | 9/2012 | Al-Thubaiti et al. | 208/61 |

* cited by examiner

*Primary Examiner* — Brian McCaig

(74) *Attorney, Agent, or Firm* — Abelman, Frayne & Schwab

(57) ABSTRACT

An integrated hydroprocessing and fluid catalytic cracking process is provided for the direct processing of a crude oil to produce olefinic and aromatic petrochemicals. Crude oil and hydrogen are charged to a hydroprocessing zone operating under conditions effective to produce a hydroprocessed effluent having a reduced content of contaminants, an increased paraffinicity, reduced Bureau of Mines Correlation Index, and an increased American Petroleum Institute gravity. The hydroprocessed effluent is separated into a low boiling fraction and a high boiling fraction. The low boiling fraction is cracked in a first downflow reactor of a fluid catalytic cracking unit in the presence of a predetermined amount of catalyst to produce cracked products and spent catalyst, and the high boiling fraction is cracked in a second downflow reactor of the fluid catalytic cracking unit in the presence of a predetermined amount of catalyst to produce cracked products and spent catalyst. Spent catalyst from both the first and second downflow reactors are regenerated in a common regeneration zone, and first and second cracked product streams are recovered.

3 Claims, 2 Drawing Sheets

INTEGRATED HYDROPROCESSING AND FLUID CATALYTIC CRACKING FOR PROCESSING OF A CRUDE OIL

RELATED APPLICATIONS

This application claims the benefit of priority of U.S. Provisional Patent Application Nos. 61/613,228 filed Mar. 20, 2012 and 61/789,871 filed Mar. 15, 2013, which are incorporated by reference herein.

BACKGROUND OF THE INVENTION

1. Field of the Invention

The present invention relates to an integrated hydroprocessing and fluid catalytic cracking process for production of petrochemicals such as olefins and aromatics from feeds including crude oil.

2. Description of Related Art

Compositions of natural petroleum or crude oils are significantly varied based on numerous factors, mainly the geographic source, and even within a particular region, the composition can vary. Crude oils are refined to produce transportation fuels and petrochemical feedstocks. Typically fuels for transportation are produced by processing and blending of distilled fractions from the crude to meet the particular end use specifications. After initial atmospheric and/or vacuum distillation, fractions are converted into products by various catalytic and non-catalytic processes.

Catalytic processes of hydrocarbon feedstocks are generally categorized based on the presence or absence of hydrogen. Processes including hydrogen, often broadly referred to as hydroprocessing, include, for example, hydrotreating primarily for desulfurization and denitrification, and hydrocracking for conversion of heavier compounds into lighter compounds more suitable for certain product specifications. A typical example of hydroprocessing is the catalytic conversion of hydrocarbon feedstock with added hydrogen at reaction conversion temperatures less than about 540° C. with the reaction zone comprising a fixed bed of catalyst. Although the fixed bed hydrocracking process has achieved commercial acceptance by petroleum refiners, this process has several disadvantages. For example, in order to achieve long runs and high on-stream reliability, fixed bed hydrocrackers require a high inventory of catalyst and a relatively high pressure, i.e., 150 kg/cm$^2$ or greater, to achieve catalyst stability. In addition, two-phase flow of reactants over a fixed bed of catalyst often creates maldistribution within the reaction zone with the concomitant inefficient utilization of catalyst and incomplete conversion of the reactants. Momentary misoperation or electrical power failure can also cause severe catalyst coking which may require the process to be shut down for catalyst regeneration or replacement.

Another type of process for certain hydrocarbon fractions is catalytic conversion without the addition of hydrogen. The most widely used processes of this type are fluidized catalytic cracking (FCC) processes. In an FCC process, a feedstock is introduced to the conversion zone typically operating in the range of about 480-550° C. with a circulating catalyst stream, thus the appellation "fluidized." This mode has the advantage of being performed at relatively low pressure, i.e., 50 psig or less. However, certain drawbacks of FCC processes include relatively low hydrogenation and relatively high reaction temperatures that tend to accelerate coke formation on the catalyst and requiring continuous regeneration.

In FCC processes, the feed is catalytically cracked over a fluidized acidic catalyst bed. The main product from such processes has conventionally been gasoline, although other products are also produced in smaller quantities, such as liquid petroleum gas and cracked gas oil. Coke deposited on the catalyst is burned off in a regeneration zone at relatively high temperatures and in the presence of air prior to recycling back to the reaction zone.

While individual and discrete hydroprocessing and FCC processes are well-developed and suitable for their intended purposes, there nonetheless remains a need for efficient conversion of a whole crude oil to produce high yield and high quality petrochemicals such as olefins and aromatics.

SUMMARY OF THE INVENTION

The system and process herein provides a hydroprocessing zone integrated with an FCC zone to permit direct processing of crude oil feedstocks to produce petrochemicals including olefins and aromatics.

An integrated hydroprocessing and fluid catalytic cracking process is provided for the direct processing of a crude oil to produce olefinic and aromatic petrochemicals. Crude oil and hydrogen are charged to a hydroprocessing zone operating under conditions effective to produce a hydroprocessed effluent having a reduced content of contaminants, an increased paraffinicity, reduced Bureau of Mines Correlation Index, and an increased American Petroleum Institute gravity. The hydroprocessed effluent is separated into a low boiling fraction and a high boiling fraction. The low boiling fraction is cracked in a first downflow reactor of a fluid catalytic cracking unit in the presence of a predetermined amount of catalyst to produce cracked products and spent catalyst. The high boiling fraction is cracked in a second downflow reactor of the fluid catalytic cracking unit in the presence of a predetermined amount of catalyst to produce cracked products and spent catalyst. Spent catalyst from both the first and second downflow reactors are regenerated in a common regeneration zone, and first and second cracked product streams are recovered.

As used herein, the term "crude oil" is to be understood to include whole crude oil from conventional sources, including crude oil that has undergone some pre-treatment. The term crude oil will also be understood to include that which has been subjected to water-oil separations; and/or gas-oil separation; and/or desalting; and/or stabilization.

Other aspects, embodiments, and advantages of the process of the present invention are discussed in detail below. Moreover, it is to be understood that both the foregoing information and the following detailed description are merely illustrative examples of various aspects and embodiments, and are intended to provide an overview or framework for understanding the nature and character of the claimed features and embodiments. The accompanying drawings are illustrative and are provided to further the understanding of the various aspects and embodiments of the process of the invention.

BRIEF DESCRIPTION OF THE DRAWINGS

The invention will be described in further detail below and with reference to the attached drawings where.

DETAILED DESCRIPTION OF THE INVENTION

Figure 1:
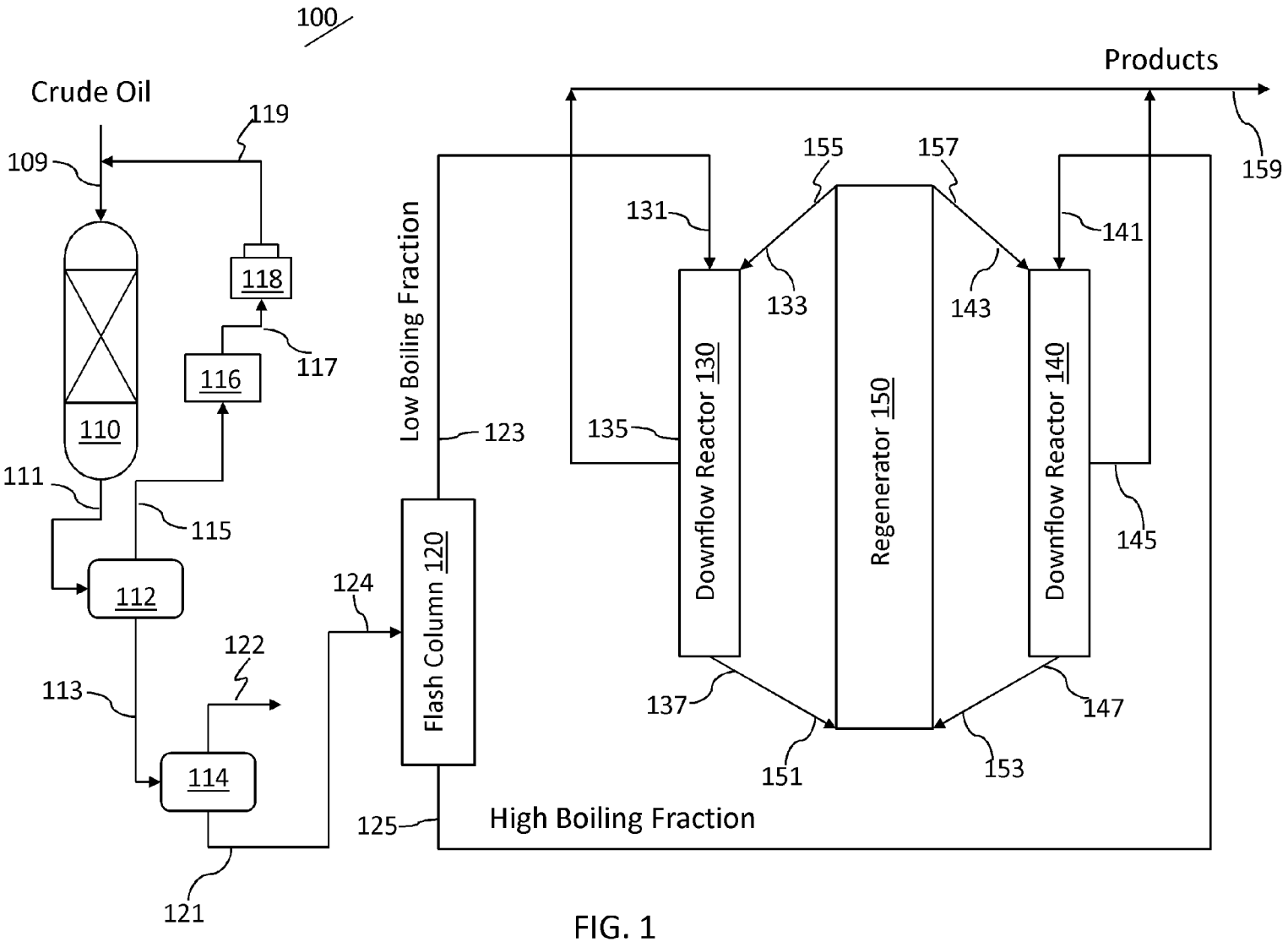
FIG. 1 is a process flow diagram of an integrated process of a hydroprocessing zone and an FCC zone described herein.

A process flow diagram including an integrated hydroprocessing and FCC process and system is shown in FIG. 1. The integrated system 100 generally includes a hydroprocessing zone 110, a flash column 120, a high severity FCC zone having two downflow reactors 130 and 140, and a regenerator 150.

Hydroprocessing zone 110 includes an inlet 109 for receiving a mixture of crude oil feed and hydrogen, and an outlet 111 for discharging a hydroprocessed effluent.

Reactor effluents 111 from the hydroprocessing reactor(s) are cooled in a heat exchanger (not shown) and sent to a high pressure separator 112. The separator tops 115 are cleaned in an amine unit 116 and a resulting hydrogen rich gas stream 117 is passed to a recycling compressor 118 to be used as a recycle gas 119 in the hydroprocessing reactor. A bottoms stream 113 from the high pressure separator 112, which is in a substantially liquid phase, is cooled and introduced to a low pressure cold separator 114 in which it is separated into a gas stream 122 and a liquid stream 121. Gases from the low pressure cold separator include hydrogen, $H_2S$, $NH_3$ and any light hydrocarbons such as $C_1$-$C_4$ hydrocarbons. Typically these gases are sent for further processing such as flare processing or fuel gas processing.

Flashing column 120 includes an inlet 124 in fluid communication with outlet 121 of the low pressure cold separator, an outlet 123 for discharging a low boiling fraction and an outlet 125 for discharging a high boiling fraction.

Downflow reactor 130 includes an inlet 131 in fluid communication with outlet 123 of flash column 120 for receiving the low boiling fraction, an inlet 133 for receiving regenerated catalyst. Downflow reactor 130 also includes an outlet 135 for discharging cracked products, and an outlet 137 for discharging spent catalyst.

Downflow reactor 140 includes an inlet 141 in fluid communication with outlet 125 of flash column 120 for receiving the high boiling fraction, an inlet 143 for receiving regenerated catalyst. Downflow reactor 140 also includes an outlet 145 for discharging cracked products, and an outlet 147 for discharging spent catalyst. Cracked products discharged from outlets 135 and 145 are recovered via outlet 159.

Figure 2:
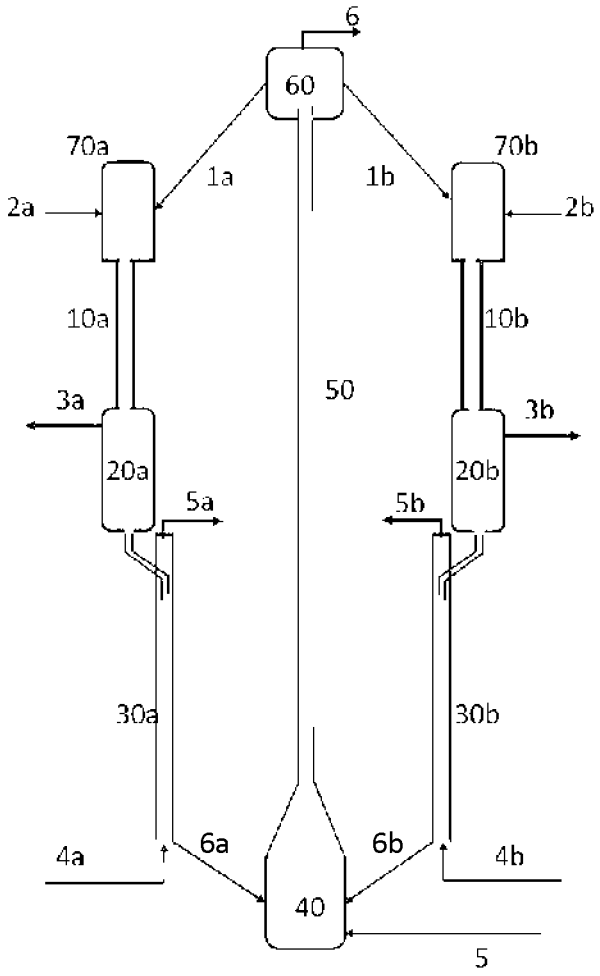
FIG. 2 is a detailed process flow diagram of an FCC zone which can be used in the integrated process described herein.

Each of the downflow-type reactors include associated therewith a mixing zone, a separator and a catalyst-stripping zone, as shown and described with respect to FIG. 2.

Regenerator 150 is shared by downflow reactors 130, 140 and includes an inlet 151 in fluid communication with outlet 137 of downflow reactor 130 for receiving the spent catalyst, and an inlet 153 in fluid communication with outlet 147 of downflow reactor 140 for receiving the spent catalyst. Regenerator 150 also includes an outlet 155 in fluid communication with inlet 133 of downflow reactor 130 for discharging the regenerated catalyst, and an outlet 157 in fluid communication with inlet 143 of downflow reactor 140 for discharging the regenerated catalyst.

A detailed diagram of an FCC system utilized in the integrated process described herein is provided in FIG. 2. The FCC system includes two mixing zones 70*a* and 70*b*, two reaction zones 10*a* and 10*b*, two separation zones 20*a* and 20*b*, two stripping zones 30*a* and 30*b*, a regeneration zone 40, a riser type regenerator 50, and a catalyst hopper 60.

Mixing zone 70*a* has an inlet 2*a* for receiving the low boiling fraction, an inlet 1*a* for receiving regenerated catalyst, and an outlet for discharging a hydrocarbon/catalyst mixture. Reaction zone 10*a* has an inlet in fluid communication with the outlet of mixing zone 70*a* for receiving the hydrocarbon/catalyst mixture, and an outlet for discharging a mixture of cracked products and spent catalyst. Separation zone 20*a* includes an inlet in fluid communication with the outlet of reaction zone 10*a* for receiving the mixture of cracked products and spent catalyst, an outlet 3*a* for discharging separated cracked products, and an outlet for discharging spent catalyst with remaining hydrocarbons. Stripping zone 30*a* includes an inlet in fluid communication with the outlet of separation zone 20*a* for receiving the spent catalyst with remaining hydrocarbons, and an inlet 4*a* for receiving stripping steam. Stripping zone 30*a* also includes an outlet 5*a* for discharging recovered product, and an outlet 6*a* for discharging spent catalyst.

Mixing zone 70*b* has an inlet 2*b* for receiving the high boiling fraction, an inlet 1*b* for receiving regenerated catalyst, and an outlet for discharging a hydrocarbon/catalyst mixture. Reaction zone 10*b* has an inlet in fluid communication with the outlet of mixing zone 70*b* for receiving the hydrocarbon/catalyst mixture, and an outlet for discharging a mixture of cracked products and spent catalyst. Separation zone 20*b* includes an inlet in fluid communication with the outlet of reaction zone 10*b* for receiving the mixture of cracked products and spent catalyst, an outlet 3*b* for discharging separated cracked products, and an outlet for discharging spent catalyst with remaining hydrocarbons. Stripping zone 30*b* includes an inlet in fluid communication with the outlet of separation zone 20*b* for receiving the spent catalyst with the remaining hydrocarbons, and an inlet 4*b* for receiving the stripping steam. Stripping zone 30*b* also includes an outlet 5*b* for discharging recovered product, and an outlet 6*b* for discharging spent catalyst.

Regeneration zone 40 includes an inlet 5 for receiving combustion gas, an inlet in fluid communication with outlet 6*a* of stripping zone 30*a* for receiving spent catalyst, an inlet in fluid communication with outlet 6*b* of stripping zone 30*b* for receiving spent catalyst, and an outlet for discharging hot regenerated catalyst.

Riser type regenerator 50 includes an inlet in fluid communication with the outlet of regeneration zone 40 for receiving hot regenerated catalyst, and an outlet for discharging moderately cooled regenerated catalyst.

Catalyst hopper 60 includes an inlet in fluid communication with the outlet of riser type regenerator 50 for receiving the cooled regenerated catalyst. Further an outlet 6 is provides for discharging fuel gases, along with outlets in fluid communication with the inlets of the mixing zone for discharging regenerated catalyst, shown as inlet 1*a* of the mixing zone 70*a* inlet 1*b* of the mixing zone 70*b*.

In a process employing the arrangement shown in FIG. 1, a crude oil feedstock is mixed with an effective amount of hydrogen and the mixture is charged to inlet 109 of hydroprocessing zone 110 at a temperature in the range of from 300° C. to 450° C. In certain embodiments, hydroprocessing zone 110 includes one or more unit operations as described in commonly owned United States Patent Publication Number 2011/0083996 and in PCT Patent Application Publication Numbers WO2010/009077, WO2010/009082, WO2010/009089 and WO2009/073436, all of which are incorporated by reference herein in their entireties. For instance, a hydroprocessing zone can include one or more beds containing an effective amount of hydrodemetallization catalyst, and one or more beds containing an effective amount of hydroprocessing catalyst having hydrodearomatization, hydrodenitrogenation, hydrodesulfurization and/or hydrocracking functions. In additional embodiments hydroprocessing zone 110 includes more than two catalyst beds. In further embodiments hydroprocessing zone 110 includes plural reaction vessels each containing catalyst beds of different function.

The hydroprocessing zone 110 operates under parameters effective to hydrodemetallize, hydrodearomatize, hydrodenitrogenate, hydrodesulfurize and/or hydrocrack the crude oil feedstock. In certain embodiments, hydroprocessing is carried out using the following conditions: operating temperature in the range of from 300° C. to 450° C.; operating pressure in the range of from 30 bars to 180 bars; and a liquid hour space velocity (LHSV) in the range of from 0.1 $h^{-1}$ to 10 $h^{-1}$. Notably, when using crude oil as a feedstock in the hydroprocessing zone 110 advantages are demonstrated, for instance, as compared to the same hydroprocessing unit operation employed for atmospheric residue. For instance, at a start or run temperature in the range of 370° C. to 375° C. with a deactivation rate of around 1° C./month. In contrast, if residue were to be processed, the deactivation rate would be closer to about 3° C./month to 4° C./month. The treatment of atmospheric residue typically employs pressure of around 200 bars whereas the present process in which crude oil is treated can operate at a pressure as low as 100 bars. Additionally to achieve the high level of saturation required for the increase in the hydrogen content of the feed, this process can be operated at a high throughput when compared to atmospheric residue. The LHSV can be as high as 0.5 while that for atmospheric residue is typically 0.25. An unexpected finding is that the deactivation rate when processing crude oil is going in the inverse direction from that which is usually observed. Deactivation at low throughput (0.25 $hr^{-1}$) is 4.2° C./month and deactivation at higher throughput (0.5 $hr^{-1}$) is 2.0° C./month. With every feed which is considered in the industry, the opposite is observed. This can be attributed to the washing effect of the catalyst. See WO2010/009077 which is incorporated by reference herein.

The hydroprocessed effluent from the hydroprocessing zone 110 (e.g., after removal of light components in a high pressure separator, not shown, which can optionally be scrubbed and recycled to the hydroprocessing zone 110 or used in another refinery process) contains a reduced content of contaminants (i.e., metals, sulfur and nitrogen), an increased paraffinicity, reduced Bureau of Mines Correlation Index (BMCI), and an increased American Petroleum Institute (API) gravity. The hydroprocessed effluent 111 is passed through a high pressure separator 112, and liquid bottoms 113 are passed through a low pressure cold separator 114. The liquid bottoms 121 of the low pressure cold separator 114 are then conveyed to flash column 120 and are separated into a low boiling fraction discharged via outlet 123 and a high boiling fraction discharged via outlet 125. The high boiling fraction contains less than 15 weight % of Conradson Carbon and less than 20 ppm of total metals. Both fractions are then sent to respective portions of the FCC unit as described below.

Referring now to FIG. 2, the low boiling fraction is introduced into mixing zone 70*a* via inlet 2*a*, and mixed with regenerated catalyst that is conveyed to mixing zone 70*a* via inlet 1*a*. The mixture is passed to reaction zone 10*a* and cracked under the following conditions: a temperature in the range of from 532-704° C.; a catalyst-oil ratio in the range of from 10:1 to 40:1; a residence time in the range of from 0.2 to 2 seconds. The mixture of cracked products and spent catalyst is passed to separation zone 20*a* and separated into cracked products discharged via outlet 3*a* and spent catalyst which is conveyed to stripping zone 30*a*. Cracked products include ethylene, propylene, butylene, gasoline (from which aromatics such as benzene, toluene and xylene can be obtained), and other by-products from the cracking reactions. Cracked products can be recovered separately in a segregated recovery section (not shown) or combined for further fractionation and eventual recovery via outlet 159. Spent catalyst is washed in the stripping zone 30*a* with stripping steam introduced via inlet 4*a*. Remaining hydrocarbon gases pass through cyclone separators (not shown) and are recovered via outlet 5*a*, and cleaned spent catalyst is conveyed to regeneration zone 40 via outlet 6*a*.

The high boiling fraction is introduced into mixing zone 70*b* via inlet 2*b*, and mixed with regenerated catalyst that is conveyed to mixing zone 70*b* via inlet 1*b*. The mixture is passed to reaction zone 10*b* and cracked under the following conditions: a temperature in the range of from 532-704° C.; a catalyst-oil ratio in the range of from 20:1 to 60:1; a residence time in the range of from 0.2 to 2 seconds. The mixture of cracked products and spent catalyst is passed to separation zone 20*b* and separated into cracked products discharged via outlet 3*b* and spent catalyst which is conveyed to stripping zone 30*b*. Cracked products include ethylene, propylene, butylene, gasoline, and other by-products from the cracking reactions. Cracked products can be recovered separately in a segregated recovery section (not shown) or combined for further fractionation and eventual recovery via outlet 159. Spent catalyst is washed in the stripping zone 30*b* with stripping steam introduced via inlet 4*b*. Remaining hydrocarbon gases pass through cyclone separators (not shown) and are recovered via outlet 5*b*, and cleaned spent catalyst is conveyed to regeneration zone 40 via outlet 6*b*.

In regeneration zone 40, spent catalyst is regenerated via controlled combustion in the presence of combustion gas, such as pressurized air, introduced via inlet 5. The regenerated catalyst is raised through riser type regenerator 50 to provide heat for the endothermic cracking reaction in reaction zones 10*a* and 10*b*. The moderately cooled regenerated catalyst is transferred to catalyst hopper 60 which functions as a gas-solid separator to remove fuel gases that contain by-products of coke combustion via outlet 6. The regenerated catalyst is recycled to mixing zones 70*a* and 70*b*.

In certain embodiments, hydroprocessing processes can increase the paraffin content (or decrease the BMCI) of a feedstock by saturation followed by mild hydrocracking of aromatics, especially polyaromatics. When hydrotreating a crude oil, contaminants such as metals, sulfur and nitrogen can be removed by passing the feedstock through a series of layered catalysts that perform the catalytic functions of demetallization, desulfurization and/or denitrogenation.

In one embodiment, the sequence of catalysts to perform hydrodemetallization (HDM) and hydrodesulfurization (HDS) is as follows:

a. The catalyst in the HDM section are generally based on a gamma alumina support, with a surface area of about 140-240 $m^2/g$. This catalyst is best described as having a very high pore volume, e.g., in excess of 1 $cm^3/g$. The pore size itself is typically predominantly macroporous. This is required to provide a large capacity for the uptake of metals on the catalysts surface and optionally dopants. Typically the active metals on the catalyst surface are sulfides of Nickel and Molybdenum in the ratio Ni/Ni+Mo<0.15. The concentration of Nickel is lower on the HDM catalyst than other catalysts as some Nickel and Vanadium is anticipated to be deposited from the feedstock itself during the removal, acting as catalyst. The dopant used can be one or more of phosphorus (see, e.g., United States Patent Publication Number US 2005/0211603 which is incorporated by reference herein), boron, silicon and halogens. The catalyst can be in the form of alumina extrudates or alumina beads. In certain embodiments alumina beads are used to facilitate unloading of the catalyst HDM beds in the reactor as the metals uptake will be ranged between from 30% to 100% at the top of the bed.

b. An intermediate catalyst can also be used to perform a transition between the HDM and HDS function. It has intermediate metals loadings and pore size distribution. The catalyst in the HDM/HDS reactor is essentially alumina based support in the form of extrudates, optionally at least one catalytic metal from group VI (e.g., molybdenum and/or tungsten), and/or at least one catalytic metals from group VIII (e.g., nickel and/or cobalt). The catalyst also contains optionally at least one dopant selected from boron, phosphorous, halogens and silicon. Physical properties include a surface area of about 140-200 $m^2/g$, a pore volume of at least 0.6 $cm^3/g$ and pores which are mesoporous and in the range of 12 to 50 nm.

c. The catalyst in the HDS section can include those having gamma alumina based support materials, with typical surface area towards the higher end of the HDM range, e.g. about ranging from 180-240 $m^2/g$. This requires higher surface for HDS and results in relatively smaller pore volume, e.g., lower than 1 $cm^3/g$. The catalyst contains at least one element from group VI, such as molybdenum and at least one element from group VIII, such as nickel. The catalyst also comprises at least one dopant selected from boron, phosphorous, silicon and halogens. In certain embodiments cobalt is used to provide relatively higher levels of desulfurization. The metals loading for the active phase is higher as the required activity is higher, such that the molar ratio of Ni/Ni+Mo is in the range of from 0.1 to 0.3 and the (Co+Ni)/Mo molar ratio is in the range of from 0.25 to 0.85.

d. A final catalyst (which could optionally replace the second and third catalyst) is designed to perform hydrogenation of the feedstock (rather than a primary function of HDS), for instance as described in Appl. Catal. A General, 204 (2000) 251. The catalyst will be also promoted by Ni and the support will be wide pore gamma alumina. Physical properties include a surface area towards the higher end of the HDM range, e.g., 180-240 $m^2/g$. This requires higher surface for HDS and results in relatively smaller pore volume, e.g., lower than 1 $cm^3/g$.

The catalyst for FCC process can be any catalyst conventionally used in FCC processes, such as zeolites, silica-alumina, carbon monoxide burning promoter additives, bottoms cracking additives, and light olefin-producing additives. The preferred cracking zeolites are zeolites Y, REY, USY, and RE-USY. To maximize and optimize the cracking of crude oil in the downflow reactors, selective catalyst additive typically used in the FCC process, i.e., ZSM-5 zeolite crystal or other pentasil type catalyst, can be mixed with cracking catalyst and added to the system.

EXAMPLE

As an example an Arab Light crude oil was hydrotreated according to the conditions in Table 1 below:

TABLE 1

| Hydrotreatment Conditions | | |
|---|---|---|
| Temperature (° C.) | LHSV ($h^{-1}$) | Pressure (bar) |
| 370 | 0.5 | 100-150 |

The properties of the initial feed and the hydrotreated product are reported in Table 2 below. The hydroprocessed feed is fractionated into two fractions at 350° C. and both fractions are then sent to the two downer HS-FCC unit. The properties of the 350° C.+fraction are also reported in Table 2.

TABLE 2

| Properties of Arab Light, upgraded Arab Light and its 350° C.+ fraction | | | | | | |
|---|---|---|---|---|---|---|
| Sample | Sulfur (wt %) | Nitrogen (ppm) | Nickel (ppm) | Vanadium (ppm) | ConCarbon (wt %) | Density |
| Arab Light | 1.94 | 961 | <1 | 14 | | 0.8584 |
| Hydrotreated Arab Light | 0.280 | 399.0 | 6 | 1 | 2.0 | 0.8581 |
| 350° C.+ | 0.540 | NA | 6.8 | 6.3 | 2.8 | 0.937 |

The method and system of the present invention have been described above and in the attached drawings; however, modifications will be apparent to those of ordinary skill in the art and the scope of protection for the invention is to be defined by the claims that follow.

The invention claimed is:

1. An integrated hydroprocessing and fluid catalytic cracking process for the direct processing of a crude oil to produce olefinic and aromatic petrochemicals, the process comprising:

a. charging the crude oil and hydrogen to a hydroprocessing zone operating under conditions effective to produce a hydroprocessed effluent having a reduced content of contaminants, an increased paraffinicity and an increased American Petroleum Institute gravity;

b. separating the hydroprocessed effluent into a low boiling fraction and a high boiling fraction;

c. cracking the low boiling fraction in a first downflow reactor of a fluid catalytic cracking unit in the presence of a predetermined amount of catalyst to produce cracked products and spent catalyst;

d. cracking the high boiling fraction in a second downflow reactor of the fluid catalytic cracking unit in the presence of a predetermined amount of catalyst to produce cracked products and spent catalyst;

e. regenerating spent catalyst from both the first and second downflow reactors in a common regeneration zone and recycling the regenerated catalyst back to the first and second downflow reactors; and f. recovering the first and second cracked product streams.

2. The process of claim 1, wherein the catalyst-oil ratio in the downflow reactor processing the low boiling fraction is in the range of 10:1 to 40:1.

3. The process of claim 1, wherein the catalyst-oil ratio in the downflow reactor processing the high boiling fraction is in the range of 20:1 to 60:1.

* * * * *